US005522313A

United States Patent [19]

Okusawa

[11] Patent Number: 5,522,313

[45] Date of Patent: Jun. 4, 1996

[54] THERMAL STENCIL MASTER PLATE AND METHOD FOR PROCESSING THE SAME

[75] Inventor: Koichi Okusawa, Tokyo-to, Japan

[73] Assignee: Riso Kagaku Corporation, Tokyo, Japan

[21] Appl. No.: 368,721

[22] Filed: Jan. 4, 1995

Related U.S. Application Data

[63] Continuation of Ser. No. 247,606, May 23, 1994, abandoned, which is a continuation of Ser. No. 120,447, Sep. 14, 1993, abandoned, which is a division of Ser. No. 835,822, Feb. 18, 1992, Pat. No. 5,243,906.

[30] Foreign Application Priority Data

Feb. 21, 1991 [JP] Japan ..... 3-27518

[51] Int. Cl.[6] ..... B41C 1/14

[52] U.S. Cl. ..... 101/128.21; 101/129

[58] Field of Search ..... 101/128.21, 128.4, 101/129, 114, 401.1

[56] References Cited

U.S. PATENT DOCUMENTS

| | | | |
|---|---|---|---|
| 4,568,951 | 2/1986 | Hasegawa et al. | 347/171 |
| 4,896,597 | 1/1990 | Hayata et al. | 101/128.21 X |
| 5,243,906 | 9/1993 | Okusawa | 101/128.21 |
| 5,245,932 | 9/1993 | Ujiie | 101/128.21 |

FOREIGN PATENT DOCUMENTS

| | | | |
|---|---|---|---|
| 0210040 | 1/1987 | European Pat. Off. | 101/128.4 |
| 60-977 | 1/1985 | Japan . | |
| 60-58876 | 4/1985 | Japan . | |
| 0053092 | 3/1986 | Japan | 101/128.21 |
| 61-68264 | 4/1986 | Japan . | |
| 2021596 | 1/1987 | Japan | 101/128.21 |
| 63-35385 | 2/1988 | Japan . | |
| 2-67133 | 3/1990 | Japan . | |
| 2207635 | 2/1989 | United Kingdom . | |
| 8504839 | 11/1985 | WIPO . | |

*Primary Examiner*—Christopher A. Bennett
*Attorney, Agent, or Firm*—Dickstein, Shapiro & Morin

[57] ABSTRACT

In the thermal stencil master plate and the method for processing the stencil master plate according to the present invention, since swelled and solidified unprocessed regions formed by film lumps or a part thereof produced from the melted film are provided continuously, the merging and excessive expansion of the perforations can be avoided so that clear printed picture images may be formed even in the regions of solid picture images. Further, the ink passing through each of the perforated dots is reliably separated from the ink passing through adjacent perforation dots before it is deposited onto the printing paper so that excessive deposition of the ink is avoided and the time required for drying the printing ink is reduced so that offsetting may be avoided.

8 Claims, 3 Drawing Sheets

THERMAL STENCIL MASTER PLATE AND METHOD FOR PROCESSING THE SAME

This application is a continuation of application Ser. No. 08/247,606 filed May 23, 1994, now abandoned, which is a continuation of application Ser. No. 08/120,447 filed Sep. 14, 1993, now abandoned, which is a divisional application of Ser. No. 07/835,822 filed Feb. 18, 1992, now patented as U.S. Pat. No. 5,243,906.

TECHNICAL FIELD

The present invention relates to a method for processing a thermal stencil master plate which is suitable for forming stencil images by perforation of a thermal stencil master plate fabricated by laminating a thermo-plastic resin film and a porous support, and a thermal stencil master plate. The present invention is particularly related to a method for processing a thermal stencil master plate by using a thermal head comprising a plurality of heat emitting elements, and a thermal stencil master plate which is suitable for forming images with a dot matrix obtained by perforating the master plate.

BACKGROUND OF THE INVENTION

The thermal stencil master plate used in stencil printing generally has a structure obtained by laminating a thermo-plastic resin film and a porous support typically consisting of a sheet of fibers. The methods for processing such a stencil master plate by perforation include the method of radiating a light beam including infrared light upon a thermal stencil master plate which is closely placed over an original, and the method of contacting a heat emitting device such as a thermal head onto a stencil master plate to form an image with a dot matrix.

According to the method of radiating a light beam including infrared light, the thermal energy absorbed by the original image causes the perforation of the thermo-plastic resin film as an optical image through an analog process, and an image identical to the original image can be formed on the stencil master plate. However, since the perforations formed in the thermo-plastic resin film of the thermal stencil master plate tend to be excessively large, deposition of ink onto the printing paper tends to be excessive. This slows down the drying of the printing ink on the printing paper, and this causes offsetting, or smearing the back of the paper due to the wet ink when the paper is piled up into a stack following the process of printing, particularly in the case of the process of rotary printing. This offsetting is particularly severe in the case of solid picture images.

According to the thermal plate making method using a thermal head, a digital process of perforation is carried out on a thermo-plastic resin film in the manner of a dot matrix by selectively heating the heat emitting elements so that a master plate image may be obtained by appropriate size distribution of the perforated dots. However, in this case, depending on the resolving power of the thermal head, the size of each of the heat emitting elements, the orientation of the fibers of the porous support, and the size of the gaps between the fibers, the perforated dots may expand and the adjacent perforated dots may merge with each other although this tendency is not so severe as in the case of the thermal plate making method based on contact duplication, and offsetting also tends to occur.

Specifically, according to the thermal plate making method using a thermal head, picture images are formed in the master plate by appropriate size distribution of perforated dots, and, in the case of a solid image, the thermal influences between adjacent heat emitting elements tends to cause excessive shrinking of the thermo-plastic resin film which in turn causes insufficiency in the cooling and solidifying of the peripheral parts of the perforated dots. As a result, lumps of the film melted during the process of perforation or parts of such lumps tend to entangle with the adjacent fibers, and this prevents passage of printing ink through the fibers during the process of printing. Further, in the printed image, because the ink which has passed through the perforations in the thermo-plastic resin film tends to contact the ink which has passed through the adjacent perforations and is about to reach or has reached the printing paper, an excessive amount of ink is often deposited on the printing paper.

Thus, according to such conventional methods, it is extremely difficult to prevent offsetting, particularly in regards to the regions of solid picture images.

To the end of solving such problems, a proposal has been made in Japanese patent laid open publication No. 02-155739 to specify the length of each of the heat emitting elements of the thermal head in the secondary scanning direction and the consistency of printing ink in a certain way. However, according to this proposal, depending on the kind of the thermo-plastic film of the thermal stencil master plate, and the ambient temperature, the size of the perforation dots and the consistency of ink tend to vary so much that the amount of ink deposition for each perforation dot becomes uneven, causing instability in the control of offsetting.

BRIEF SUMMARY OF THE INVENTION

In view of such problems of the prior art, a primary object of the present invention is to provide a thermal stencil master plate and a method for processing a thermal stencil master plate which can reproduce clear printed images, achieve a high level of printing density, and prevent the occurrence of offsetting.

These and other objects of the present invention can be accomplished by providing a method for processing a thermal stencil master plate so as to form an image by perforating a thermal stencil master plate fabricated by laminating a thermo-plastic resin film and a porous support, comprising the step of forming a substantially continuous unprocessed portion around a peripheral part of each of said perforations forming an image, said unprocessed portion consisting of a swelled and solidified lump of said thermo-plastic resin film which was melted during said process of perforation, or a thermal stencil master plate fabricated by laminating a thermo-plastic resin film and a porous support, wherein a substantially continuous unprocessed portion is formed around a peripheral part of each of perforations provided in said thermo-plastic resin film so as to form an image, said unprocessed portion consisting of a swelled and solidified lump of said thermo-plastic resin film which was melted during a process of perforating said thermo-plastic resin film.

The heat source for perforation in the above mentioned method for processing a thermal stencil master plate may consist of a thermal head comprising a plurality of heat emitting elements, and the perforated dots may be arranged as a dot matrix for forming images.

In the thermal head which is employed in the method for processing a thermal stencil master plate according to the present invention, the ratios of the lateral (primary scanning direction) and longitudinal (secondary scanning direction) dimensions of each of the heat emitting elements to the corresponding dot pitches are desired to be 30 to 80% and 60 to 98%, respectively, more desirably to be 35 to 75% and 75 to 95%, respectively, and most desirably to be 40 to 65% and 75 to 90%, respectively.

The method for fabricating the thermal head (thin film or thick film) and the kind of the glaze layer (full or partial) are not limited to any particular types.

In the non-contact method of perforating the thermo-plastic resin film of a thermal stencil master plate with a laser beam or the lik, since there is no influences from adjacent dots, it suffices if the diameter of the beam and the dot pitches are determined in such a manner that unprocessed regions may be formed by swelling and solidification of film lumps or parts thereof arising from the thermo-plastic resin film which is melted in the regions between adjacent perforation dots.

The thermo-plastic resin film of the thermal stencil master plate to which the present invention is applied may be made of polyester, polycarbonate, polypropylene, polyvinylchloride, polyvinylchloride-polyvinylidene copolymer, or other resin material, and its thickness is desired to be less than 10 μm, preferably 0.5 to 6.0 μm. The method for making the thermo-plastic resin film is not limited to any particular method, but the film is desired to be consisting of a biaxially oriented film in terms of heat shrinking and heat responding properties (solidifying property when being cooled following the application of heat emitting elements).

The porous support of the thermal stencil master plate to which the present invention is applied may consist of porous thin paper made of such materials as synthetic fibers, such as polyester fibers, vinylon fibers, and rayon fibers, natural fibers, such as manila hemp, kozo and mitsumata (** which are fibers derived from native Japanese plants of the same names for making high quality Japanese paper), or a mixture of these. The basis weight of the porous support may be 6 to 14 g/m$^2$, preferably 8 to 13 g/m$^2$. The thickness of the porous support may be 10 to 60 μm, preferably 15 to 55 μm.

The porous support contains gaps between the fibers, and the fiber gaps smaller than pixels (primary scanning pitch× secondary scanning pitch) in size are desired to occupy 60 to 100% of the total area of all the fiber gaps, preferably 80 to 100% of the total area of the fiber gaps.

The ink used for stencil printing using the thermal stencil master plate of the present invention is desired to have a one-minute spread meter reading of 30 to 40, preferably 32 to 38.

According to such a thermal stencil master plate and a method for processing the stencil master plate, the perforations defining a picture image are ensured to be each separated from the surrounding perforations, and the ink that is to be deposited on the printing paper is prevented from being dispersed to the adjacent regions by the aforementioned swelled portions, thereby achieving a clear printed image free from merging and thickening of lines in character images. Further, the amount of ink deposition is controlled for each of the perforations defining a picture image, or, in other words, for each of the perforations surrounded by the swelled regions, thereby preventing any excessive deposition of printing ink onto the printing paper. This makes a significant contribution to the reduction of offsetting. This is particularly important in the case of stencil printing in which the master plate is processed by digital perforation of the master plate using a thermal head.

In particular, according to the thermal stencil master plate and the method for processing the stencil master plate according to the present invention, since swelled and solidified unprocessed regions formed by the film lumps or a part thereof produced from the melted film are provided continuously, the ink passing through each of the perforated dots is reliably separated from the ink passing through adjacent perforation dots before it is deposited onto the printing paper so that excessive deposition of the ink is avoided and the time required for drying the printing ink is reduced so that offsetting may be avoided.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
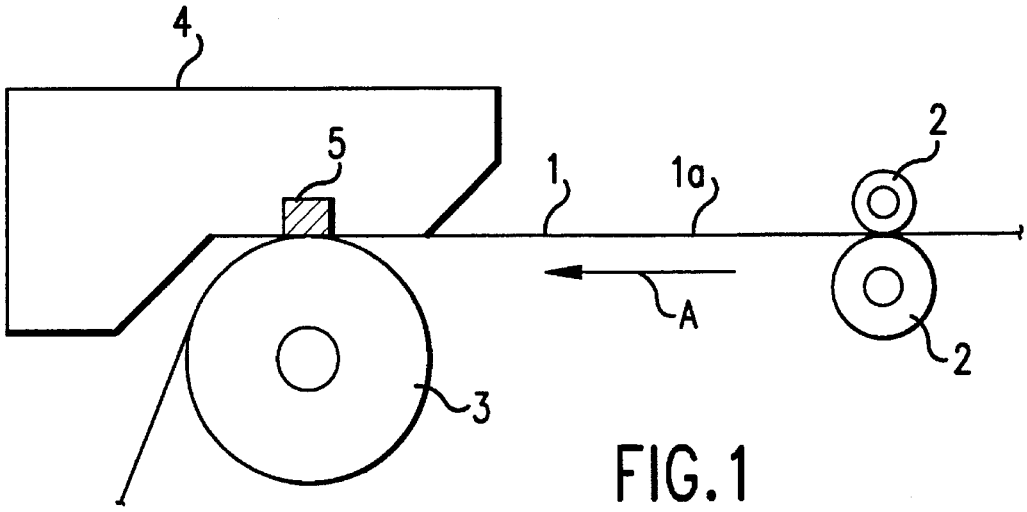
FIG. 1 is schematic structural view of an example of the thermal recording device which can be employed for carrying out the method for processing a thermal stencil master plate according to the present invention.

FIG. 1 shows an embodiment of the thermal recording device which may be employed for carrying out the method for processing the thermal stencil master plate according to the present invention. In the illustrated thermal recording device, thermal recording material 1 is held between a pair of conveyer rollers 2, and is conveyed in the direction indicated by the arrow A (secondary scanning direction) until it is placed between a platen roller 3 and a thermal head 4. Then, heat emitting elements 5 provided in the thermal head 4 are directly contacted to a recording surface (surface 1*a* in the drawing) of the thermal recording material 1, and recorded images are formed on the recording surface 1*a* of the recording material 1 by selectively heating the heat emitting elements 5.

The thermal head 4 is provided with a plurality of rectangular heat emitting elements 5 arranged in a row at a prescribed pitch in a primary scanning direction which is perpendicular to the secondary scanning direction or the direction of the feeding movement or the relative movement of the thermal stencil master plate. Each of the heat emitting elements is provided with an electrode (not shown in the drawing) at each end thereof along the secondary scanning direction so that electric power may be individually supplied to each of the heat emitting elements 5.

The thermal stencil master plate 1 is fabricated by laminating a thermo-plastic resin film and a porous support, and, according to the present invention, is processed in such a manner that the periphery of each of the perforated dots defining a picture image is provided with a swelled and solidified region derived from the melted thermo-plastic resin film.

In the thermal head 4 which is employed in the method for processing the thermal stencil master plate according to the present invention, each of the heat emitting elements occupies 30 to 80% of the dot pitch in the lateral (primary scanning) direction, and 60 to 98% in the longitudinal (secondary scanning) direction.

The thermo-plastic resin film of the thermal stencil master plate 1 to which the present invention is applied may be made of polyester, polycarbonate, polypropylene, polyvinylchloride, polyvinylcholoride-polyvinylidene copolymer, or other resin material, and its thickness is desired to be less than 10 μm, preferably 0.5 to 6.0 μm. The porous support of the thermal stencil master plate consists of porous thin paper made of such materials as synthetic fibers, such as polyester fibers, vinylon fibers, and rayon fibers, natural fibers, such as manila hemp, kozo and mitsumata (** translator's note: plant fibers used for making high quality Japanese paper), or a mixture of these. The weight of the porous support may be 6 to 14 g/m$^2$, preferably 8 to 13 g/m$^2$. The thickness of the porous support may be 10 to 60 μm, preferably 15 to 55 μm.

The porous support contains gaps between the fibers, and the fiber gaps smaller than pixels (primary scanning pitch× secondary scanning pitch) in size are desired to occupy 60 to 100% of the total area of all the fiber gaps, preferably 80 to 100% of the total area of all the fiber gaps.

Figure 2:
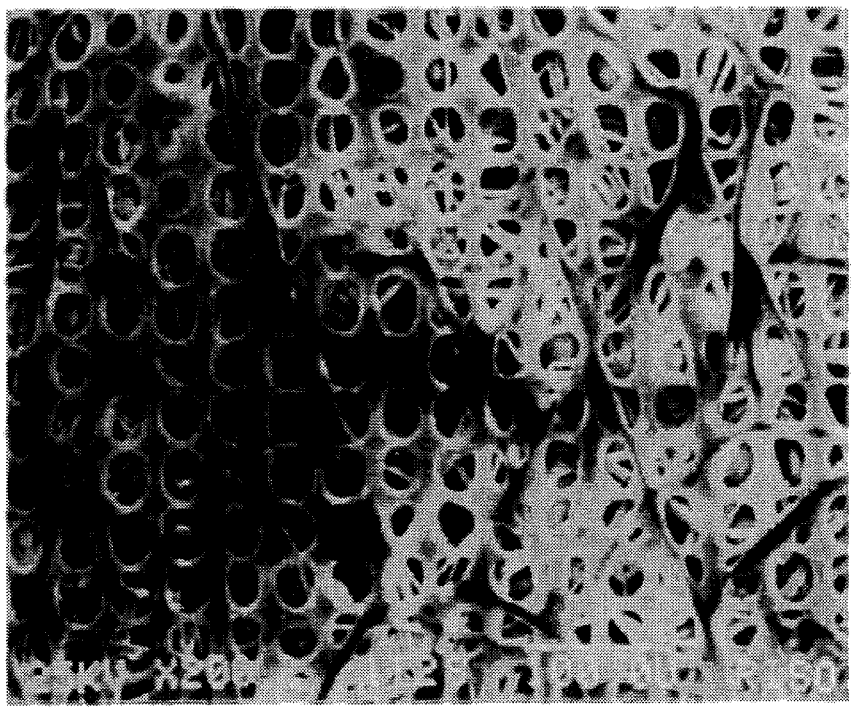
FIG. 2 is a microscopic photograph of the condition of a solid image region of the thermal stencil master plate processed by the method of the present invention obtained with an electron microscope at a magnification factor of 200.
Figure 3:
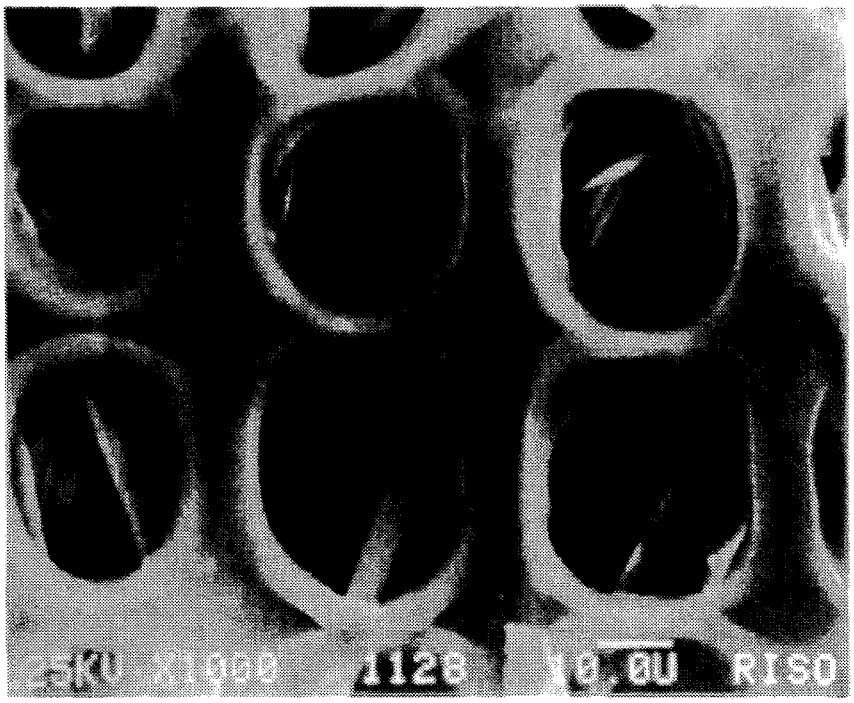
FIG. 3 is a microscopic photograph further magnifying a part of FIG. 2 at an overall magnification factor of 1,000.

FIG. 2 is a microscopic photograph of the condition of a solid image region of the thermal stencil master plate processed by using a thermal head as described above with an electron microscope at a magnification factor of 200, and FIG. 3 is a microscopic photograph of a part of the solid image at a magnification factor of 1,000.

As can be seen from FIGS. 2 and 3, the perforated dots defining a solid picture image form a matrix of separate and evenly perforated dots, and unprocessed gaps are defined between adjacent perforated dots in both the primary and secondary directions.

Then, the thermo-plastic resin film containing a solid picture image was peeled off from the thermal stencil master plate, and the surface condition of the peripheral parts of the perforated dots was analyzed by using a three-dimensional surface roughness meter SE-30K (made by KK Kosaka Kenkyusho) along the primary scanning direction.

Figure 4:
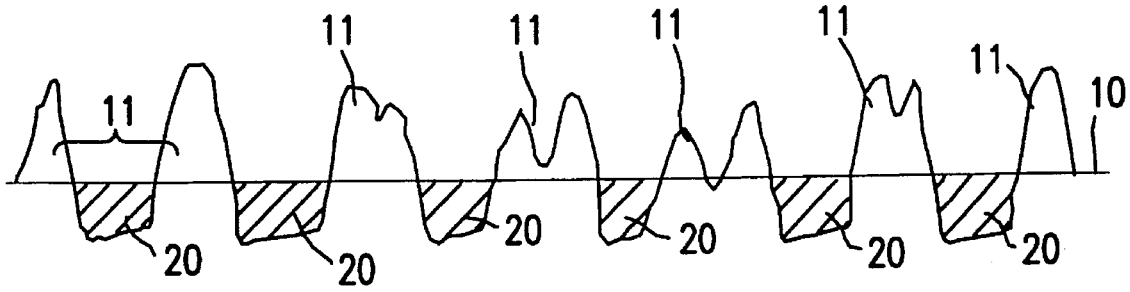
FIG. 4 is a graph showing the condition of the swelled portions around each of the perforated dots obtained by using a three-dimensional surface roughness measuring device applied in the primary scanning direction on a thermo-plastic film containing solid images peeled off from a thermal stencil master plate which was obtained by the method of processing a thermal stencil master plate according to the present invention.

The result of this analysis is illustrated in FIG. 4. In this drawing, numeral 10 denotes an unprocessed thermo-plastic film surface, numeral 11 denotes swelled portions formed of film lumps or parts thereof, and numeral 20 denotes perforations (indicated by hatched lines). It shows that swelled portions arising from film lumps or parts thereof were formed continuously around each of the perforations.

Figure 5:
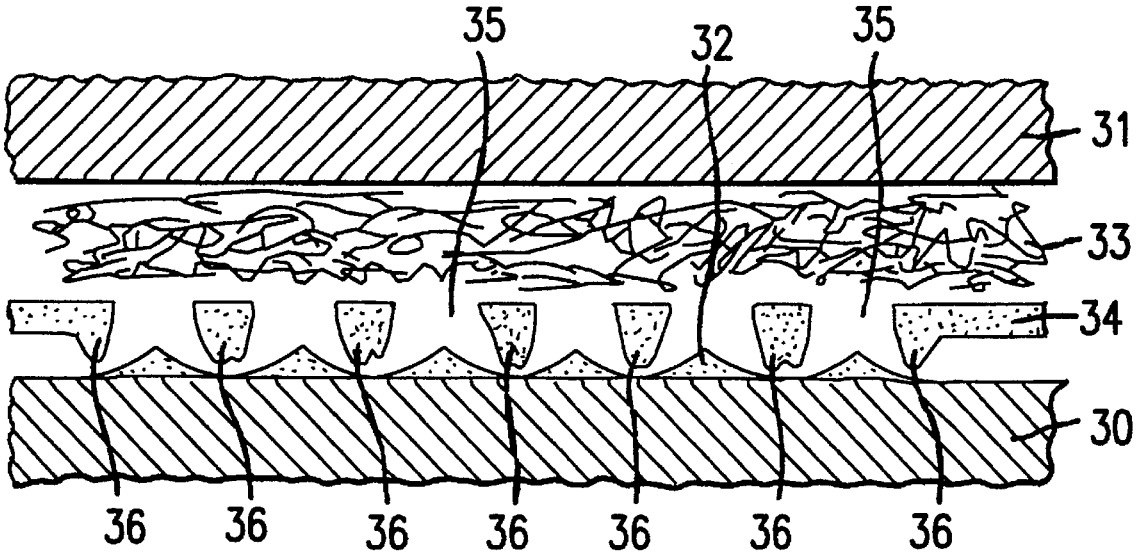
FIG. 5 is a model diagram showing the condition of ink deposition in a region of a solid image at the time of printing with a thermal stencil master plate obtained by the method of processing a thermal master plate according to the present invention.

FIG. 5 shows a schematic diagram illustrating the condition of ink deposition in a region of a solid picture image when a print was made by using a thermal stencil master plate in which swelled portions consisting of film lumps or parts thereof derived from melted thermo-plastic resin film were formed around each of the perforations.

In FIG. 5, the ink passed downward through a drum mesh 31, a porous support 33, and perforations 35 provided in the thermo-plastic resin film 34, and was deposited onto the surface of printing paper 30 as lumps of ink. The periphery of each perforated dot was provided with a continuous swelled portion 36 formed by film lumps or parts thereof arising from the thermo-plastic resin film melted at the time of perforation, and the lumps of ink 32 which passed through the perforations before being deposited onto the printing paper were minimized insofar as to allow formation of solid images and were uniformly distributed over the perforations. As a result, highly uniform solid images were obtained while the occurrence of offsetting was effectively controlled.

Further, when a large number of prints were made by using a thermal stencil master plate having the aforementioned swelled portions, the number of prints that can be printed with a given amount of ink was increased as compared with the case when a conventional thermal stencil master plate is used. It means that the amount of ink needed for each print can be reduced.

Figure 6:
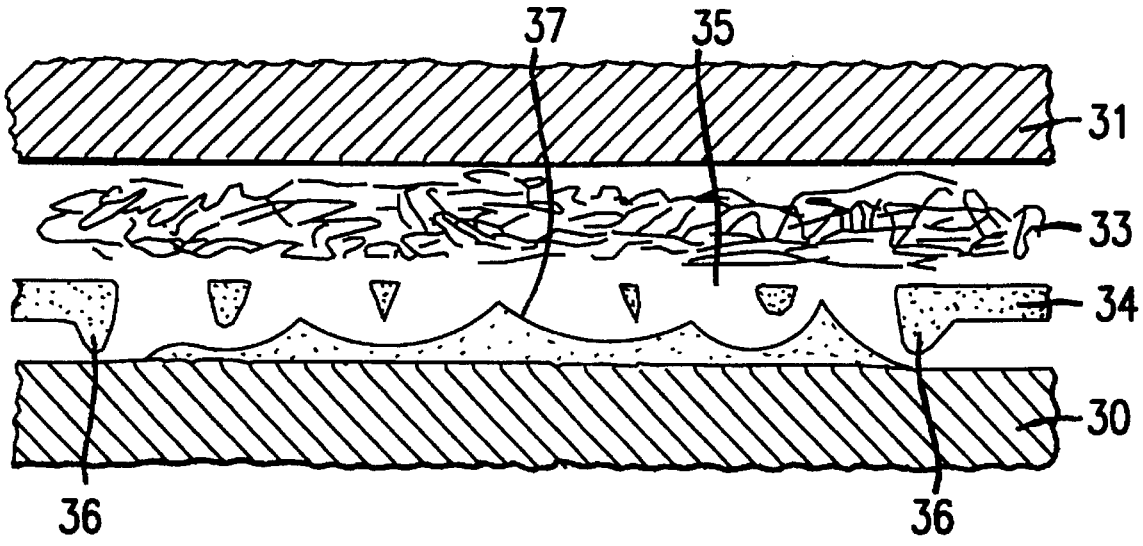
FIG. 6 is a model diagram showing the condition of ink deposition in a region of a solid image at the time of printing with a thermal stencil master plate obtained by the conventional method of processing a thermal master plate.

FIG. 6 is a schematic view showing the condition of ink deposition when a print was made by using a master plate (involving perforations for solid images) processed by a conventional method for processing thermal stencil master plates. In this case, swelled portions 36 which were formed by film lumps or parts thereof arising from the thermo-plastic resin film melted during the process of perforation were formed only in the edges of solid images which were not affected by adjacent dots, and a significant amount of merging and expansion of the perforated dots occurred in the areas of solid images due to the thermal interferences from adjacent heat emitting elements, or such swelled portions were very few in number, totally absent, or entangled with adjacent fibers.

As a result, the amount of ink passing through each perforation was excessive, or uneven, or the passage of ink was obstructed by the lumps of film which entangled with the fibers of the support. In FIG. 6, the obstruction of the passage of ink by the lumps of film is not illustrated.

Referring to FIG. 6, when prints were made by using a thermal stencil master plate involving thermal interferences between adjacent heat emitting elements, expansion and merging of perforated dots were conspicuous, and excessive ink lumps 37 were deposited onto the printing paper 30 in the areas of solid images so that significant offsetting was present when a plurality of prints were made. Further, there was the problem of excessive ink consumption.

Now the present invention is described in the following in terms of embodiments and examples for comparison.

TABLE 1

| Examples | size of each heat emitting element of the thermal head a: primary b: secondary ( ): length ratio to dot pitch | thermo-plastic resin film kind/ thickness | porous support fibers basis weight percentage of gaps smaller than pixels |
|---|---|---|---|
| Embodiment #1 | a = 25 (39.4%) b = 60 (94.5%) | polyester 2 μm | hemp 9.0 g/m$^2$ 85% |
| Embodiment #2 | a = 35 (55.1%) b = 60 (94.5%) | polyester 2 μm | hemp 9.0 g/m$^2$ 85% |
| Embodiment | a = 44 (69.3%) b = 60 (94.5%) | polyester 2 μm | hemp + polyester 11.0 g/m$^2$ |

TABLE 1-continued

| Examples | size of each heat emitting element of the thermal head a: primary b: secondary ( ): length ratio to dot pitch | thermo-plastic resin film kind/ thickness | porous support fibers basis weight percentage of gaps smaller than pixels |
|---|---|---|---|
| #3 | | | 82% |
| Exmpl. #1 for compar. | a = 53 (83.5%) b = 60 (94.5%) | polyester 2 μm | hemp 9.0 g/m$^2$ 85% |
| Exmpl. #2 for compar. | a = 44 (69.3%) b = 60 (94.5%) | polyester 2 μm | hemp 10.0 g/m$^2$ 55% |
| Exmpl. #3 for compar. | a = 44 (69.3%) b = 85 (133.9%) | polyester 2 μm | hemp 9.0 g/m$^2$ 85% |

The thermal heads used in the embodiments and the examples for comparison each consisted of a 400 dots/inch thin film type fully glazed thermal head, and were mounted on a digital stencil master plate making/printing device (made by Riso Kagaku Kogyo KK under the tradename of Risograph RC-115D). The dot pitch was 63.5 μm in both the primary and secondary scanning directions.

In Embodiment #1, the condition and the printing capability of the stencil master plate were investigated by using a master plate made by laminating a polyester film of 2 μm thickness with a porous support consisting of hemp fibers of 9.0 g/m$^2$ weight with the gaps smaller than the size of the pixels (primary scanning pitch×secondary scanning pitch= 4,032.25 μm$^2$) accounting for 85% of the total area of the gaps. The ratio of the size of each heat emitting element of the thermal head to the dot pitch was 39.4% and 94.5% for the lateral (primary scanning length) and longitudinal (secondary scanning length) dimensions, respectively, and the level of the applied energy was 68.8 to 55.0 μJ/dot.

In regard to the condition of the stencil master plate in the areas of solid images, swelled portions formed by lumps of the thermo-plastic resin film melted during the process of perforation or parts thereof were observed to be distributed continuously along the periphery of each perforated dot. It means that the process of perforation by each heat emitting element was not thermally interfered by adjacent heat emitting elements, and the condition of the stencil master plate was thus favorable.

When stencil printing was carried out by using this favorably processed thermal stencil master plate, clear character images, and uniform solid images with high levels of printing density were obtained without the inconvenience of involving offsetting. The consumption of ink was also low.

In Embodiment #2, an identical thermal stencil master plate as that of Embodiment #1 was used. The ratio of the size of each heat emitting element of the thermal head to the dot pitch was 55.1% and 94.5% for the lateral (primary scanning length) and longitudinal (secondary scanning length) dimensions, respectively, and the level of the applied energy was 75.0 to 60.0 μJ/dot. In this case also, the condition and the printing capability of the stencil master plate were both favorable in the same manner as Embodiment #1, and the obtained prints were likewise favorable.

In Embodiment #3, the condition and the printing capability of the stencil master plate were investigated by using a master plate made by laminating a polyester film of 2 μm thickness with a porous support consisting of a mixture of hemp and polyester fibers of 11.0 g/m$^2$ weight with gaps smaller than the size of the pixels (4,032.25 μm$^2$) accounting for 82% of the total area of the gaps. The ratio of the size of each heat emitting element of the thermal head to the dot pitch was 69.3% and 94.5% for the lateral (primary scanning length) and longitudinal (secondary scanning length) dimensions, respectively, and the level of the applied energy was 81.3 to 65.0 μJ/dot.

In this case also, the condition and the printing capability of the stencil master plate were both favorable in the same manner as in Embodiment #1.

In Example #1 for comparison, an identical thermal stencil master plate as that of Embodiment #1 was used. The ratio of the size of each heat emitting element of the thermal head to the dot pitch was 83.5% and 94.5% for the lateral (primary scanning length) and longitudinal (secondary scanning length) dimensions, respectively, and the level of the applied energy was 87.5 to 70.0 μJ/dot.

In regard to the condition of the stencil master plate in the areas of solid images, swelled portions formed by lumps of the thermo-plastic resin film melted during the process of perforation or parts thereof were observed only at the outer edges of solid images where thermal interferences from adjacent heat emitting elements were absent, and there were severe expansion and merging of perforated dots, thereby rendering the dot matrix forming solid images poor in uniformity.

When prints were made by using the thus processed thermal stencil master plate, the thickening and blurring of the lines in the character images were observed, and the solid images involved excessive unevenness in density. Further, when multiple prints were made, there was severe offsetting.

In Example #2 for comparison, the condition and the printing capability of the stencil master plate were investigated by using a master plate made by laminating a polyester film of 2 μm thickness with a porous support consisting of hemp fibers of 10.0 g/m$^2$ weight with gaps smaller than the size of the pixels (4,032.25 μm$^2$) accounting for 55% of the total area of the gaps. The thermal head and the level of energy for processing the stencil master plate were identical to those of Embodiment 1.

In this case, as was the case with Example #1 for comparison, the condition and the printing capability of the stencil master plate were both unsatisfactory.

In Example #3 for comparison, an identical thermal stencil master plate as that of Embodiment #1 was used. The ratio of the size of each heat emitting element of the thermal head to the dot pitch was 69.3% and 133.9% for the lateral (primary scanning length) and longitudinal (secondary scanning length) dimensions, respectively, and the level of the applied energy was 100.0 to 80.0 μJ/dot.

In this case, expansion and merging of perforated dots in the areas of solid images in the stencil master plate were even more severe than those of Examples #1 and #2 for comparison, and there were almost no swelled portions between the perforated dots. This was caused by the fact that the film lumps formed by the thermo-plastic resin film which was melted during the process of perforation were entangled with the adjacent fibers of the support and covered the perforated dots without forming swelled portions around each of the perforated dots. Therefore, the shapes of the perforated dots were random, and this, combined with the blocking of the perforated dots by melted film lumps, reduced the resolving power of the stencil master plate below the resolving power (400 dots/inch) of the thermal head. When prints were made by using the thus processed stencil master plate, the blurring and thickening of the lines were produced in the character images. Also, solid images involved excessive unevenness in density, imprints of fibers, and breaks and blurring of the lines in character images, and there was excessive offsetting. Even though there were localized low density areas, the consumption of ink was significant.

The results of the embodiments and the examples for comparison are summarized in Table 2.

TABLE 2

| | plate condition | | printing properties | | | |
|---|---|---|---|---|---|---|
| Examples | dot shapes | swelled portions | character clarity | uniformity of solid images | offsetting | amount of ink deposition |
| Embodiment #1 | o | o | o | o | o | o |
| Embodiment #2 | o | o | o | o | o | o |
| Embodiment #2 | o | o | o | o | o | o |
| Example #1 for comparison | ⌂ | ⌂ | ⌂ | ⌂ | ⌂ | ⌂ |
| Example #2 for comparison | ⌂ | ⌂ | ⌂ | ⌂ | ⌂ | ⌂ |
| Example #3 for comparison | x | x | x | x | x | x |

In Table 2, "O" denotes "good", "⌂" denotes fair, and "x" denotes "poor". The bases for these rating for each of the items for evaluation are given in the following:

1. Plate condition
   1) perforations
   O: the shapes of the perforated dots are even.
   ⌂: the shapes of the perforated dots are uneven, and there are expanded and merged dots.
   x: the expansion and merging of dots are severe.
   2) swelled portions around each perforated dot
   O: swelled portions are continually formed around each perforated dot.
   ⌂: swelled portions are absent in the areas where adjacent dots are merged together.
   x: there are almost no swelled portions.
2. Printing properties
   1) clarity of character images
   O: clear
   ⌂: partly thickening and blurring
   x: some spreading and localized loss in density
   2) evenness of solid images
   O: even
   ⌂: some unevenness
   x: severe unevenness
   3) offsetting
   O: none
   ⌂: only in solid image regions
   x: severe
   4) amount of ink deposition
   O: controlled
   ⌂: partly excessive
   x: excessive From the results obtained from the embodiments and the examples for comparison, it was found that the plate condition and the printing properties of the thermal stencil master plate are strongly affected by the size of each heat emitting element of the thermal head and the size of the gaps in the fibers of the porous support of the stencil master plate.

Since the present invention consists of the method for processing thermal stencil master plates in which the peripheral part of each of the perforated dots is provided with swelled portions formed by the film lumps arising from the melting of the thermo-plastic resin film or parts thereof, each of the perforated dots is formed without being thermally affected by adjacent heat emitting elements and a uniform dot matrix is formed even in the regions of solid images so that not only clear character images can be obtained but also the amount of ink deposition can be controlled even in the regions of solid images with the overall results that prints of high density levels can be obtained without the inconvenience of offsetting, and the economic advantage can be obtained through reduction in the consumption of ink.

Although the present invention has been described in terms of preferred embodiments thereof, it is obvious to a person skilled in the art that various alterations and modifications are possible without departing from the scope of the present invention which is set forth in the appended claims.

What we claim is:

1. A method for processing a thermal stencil master plate to form an image thereon by perforation, said thermal stencil master plate comprising a thermoplastic resin film laminated on a fibrous porous support having fiber gaps, said method comprising the steps of:

providing a thermal stencil master plate comprising a fibrous porous support having fibers and fiber gaps between said fibers, and a thermoplastic resin film laminated on said fibrous porous support;

providing a heat source comprising a thermal head including a plurality of heat emitting elements;

applying said thermal stencil master plate to said heat source;

forming with said heat source a plurality of perforations in said thermal stencil master plate and a substantially continuous unprocessed portion in said thermal stencil master plate around a peripheral part of each of said perforations to thereby form a dot matrix image, said unprocessed portion including a swelled and solidified lump of said thermoplastic resin film which was melted during the formation of said perforations;

wherein said heat emitting elements are arranged in a single row in a primary scanning direction, and said thermal stencil master plate is applied to said heat source by moving it in a secondary scanning direction, which is perpendicular to said primary scanning direction, relative to said thermal head, the ratios of dimensions of each of said heat emitting elements to corresponding dot pitches of said dot matrix in said primary and secondary scanning direction being 30 to 80% and 60 to 98%, respectively; said heat emitting elements having primary scanning pitches and secondary scanning pitches defining pixels; and the total area of the fiber gaps of said porous support which are smaller than said pixel in size occupying 60 to 100% of the total area of all the fiber gaps.

2. A method for processing a thermal stencil master plate according to claim 1, wherein said thermoplastic resin film of said thermal stencil master plate is made of a material selected from a group consisting of polyester, polycarbonate, polypropylene, polyvinylchloride, polyvinylchloride-polyvinylidene copolymer.

3. A method of processing a thermal stencil master plate according to claim 2, wherein a thickness of said thermoplastic resin film is less than 10 μm.

4. A thermal stencil master plate formed by heat emitting elements having primary scanning pitches and secondary scanning pitches defining pixels comprising:

a thermoplastic resin film laminated to a fibrous porous support;

a plurality of perforations formed in said thermal stencil master plate by a thermal perforation process, said plurality of perforations producing an image; and a substantially continuous unprocessed portion formed around a peripheral part of each of said perforations, said unprocessed portion including a swelled and solidified lump of said thermoplastic resin film produced during the process of thermally perforating said thermoplastic resin film; and the fibers of said porous support having fiber gaps, the total area of the fiber gaps which are smaller than said pixel in size occupying 60 to 100% of the total area of all the fiber gaps.

5. A thermal stencil master plate according to claim 4, wherein said plurality of perforations define a dot matrix forming said image.

6. The combination of a thermal recording device for forming a dot matrix image on a thermal recording material, and said thermal recording material, the combination comprising:

a thermoplastic resin film laminated on a fibrous porous support having fiber gaps, a thermal head comprising a plurality of heat emitting elements arranged in a single row at first pitch along a primary scanning direction of said thermal recording material, means for moving said thermal recording material in a secondary scanning direction perpendicular to said primary scanning direction to enable said thermal recording material to contact with said heat emitting elements;

said thermal head selectively heating said heat emitting elements for each successive movement of said thermal recording material at a second pitch in said secondary scanning direction, wherein:

a ratio of length of each of said heat emitting elements of said thermal head in said primary scanning direction to said first pitch is 30 to 70%, and a ratio of a length of each of said heating elements of said thermal head in said secondary scanning direction to said second pitch is 60 to 95%;

the fibers of said porous support having fiber gaps, the total area of the fiber gaps which are smaller than said pixel in size occupying 60 to 100% of the total area of all the fiber gaps.

7. A combination according to claim 6, wherein said thermoplastic resin film of said thermal recording material is made of a material selected from a group consisting of polyester, polycarbonate, polypropylene, polyvinylchloride, polyvinylchloride-polyvinylidene copolymer.

8. A combination according to claim 7, wherein a thickness of said thermoplastic resin film is less than 10 μm.

* * * * *